US007949289B2

(12) United States Patent
Matsuyama et al.

(10) Patent No.: US 7,949,289 B2
(45) Date of Patent: May 24, 2011

(54) IMAGE FORMING APPARATUS AND IMAGE FORMING ADJUSTMENT METHOD

(75) Inventors: Kengo Matsuyama, Osaka (JP); Yoshikazu Harada, Nara (JP); Norio Tomita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1130 days.

(21) Appl. No.: 11/523,321

(22) Filed: Sep. 18, 2006

(65) Prior Publication Data

US 2007/0071510 A1 Mar. 29, 2007

(30) Foreign Application Priority Data

Sep. 28, 2005 (JP) ..... 2005-282326

(51) Int. Cl.
*G03G 15/01* (2006.01)

(52) U.S. Cl. ..... 399/301

(58) Field of Classification Search ..... 399/15, 399/72, 179, 301
See application file for complete search history.

(56) References Cited

U.S. PATENT DOCUMENTS 5,444,525 A * 8/1995 Takahashi et al. ..... 399/76
5,510,885 A * 4/1996 Mori et al. ..... 399/28
5,576,753 A * 11/1996 Kataoka et al. ..... 347/248
5,881,346 A * 3/1999 Mori et al. ..... 399/301
5,940,114 A * 8/1999 Kataoka et al. ..... 347/248
5,995,802 A * 11/1999 Mori et al. ..... 399/394
6,188,418 B1 * 2/2001 Hata ..... 347/116
6,324,355 B1 * 11/2001 Matsui et al. ..... 399/38
6,330,404 B1 * 12/2001 Munenaka et al. ..... 399/51
6,348,937 B2 * 2/2002 Hata ..... 347/116
6,360,070 B1 * 3/2002 Taka et al. ..... 399/301
6,876,821 B2 4/2005 Ishii et al.
7,003,241 B1 * 2/2006 Kobayashi et al. ..... 399/72
7,130,551 B2 * 10/2006 Kobayashi ..... 399/49
7,224,378 B2 * 5/2007 Maeda ..... 347/235
7,239,833 B2 * 7/2007 Tomita et al. ..... 399/299

(Continued)

FOREIGN PATENT DOCUMENTS

JP 2003-177588 6/2003

(Continued)

OTHER PUBLICATIONS

English translation of Umeda (JP pub 2004-069801).*

*Primary Examiner* — David M Gray
*Assistant Examiner* — Geoffrey T Evans
(74) *Attorney, Agent, or Firm* — David G. Conlin; Steven M. Jensen; Edwards Angell Palmer & Dodge LLP

(57) ABSTRACT

Multiple photoconductive drums on which images with different color components are formed respectively are rotated using individual motors, multiple adjustment images are formed at a predetermined interval along the cycle length of one rotation of each photoconductive drum, the reference phases for the rotation of the respective photoconductive drums are determined based on the maximum portions of the divergences between the predetermined interval and the detection interval of each adjustment image, and the individual motors are controlled so that the respective reference phases determined are aligned. The image forming region corresponding to the cycle length of one rotation of the photoconductive drum is divided into four or more even-numbered regions, the divergence amount of each region is calculated, and the maximum portions of the divergences are determined based on the difference between the divergence amounts of the divided regions being away from each other by a half cycle length.

5 Claims, 11 Drawing Sheets

U.S. PATENT DOCUMENTS

| | | | | |
|---|---|---|---|---|
| 7,509,082 | B2 * | 3/2009 | Goto | 399/301 |
| 7,619,642 | B2 * | 11/2009 | Matsuyama et al. | 347/118 |
| 7,636,533 | B2 * | 12/2009 | Kikuchi et al. | 399/167 |
| 2001/0006544 | A1 * | 7/2001 | Kawasaki et al. | 375/376 |
| 2004/0057739 | A1 * | 3/2004 | Shimura | 399/49 |
| 2004/0179885 | A1 * | 9/2004 | Adkins et al. | 400/636.1 |
| 2005/0053389 | A1 * | 3/2005 | Tanaka et al. | 399/66 |
| 2005/0190420 | A1 * | 9/2005 | Imai et al. | 359/210 |
| 2006/0132880 | A1 * | 6/2006 | Amada et al. | 359/196 |
| 2006/0165442 | A1 * | 7/2006 | Kobayashi et al. | 399/301 |
| 2006/0203070 | A1 * | 9/2006 | Matsuyama et al. | 347/116 |
| 2006/0222418 | A1 * | 10/2006 | Ebara et al. | 399/301 |
| 2007/0242980 | A1 * | 10/2007 | Kikuchi et al. | 399/167 |
| 2007/0242986 | A1 * | 10/2007 | Matsuyama et al. | 399/301 |
| 2008/0226361 | A1 * | 9/2008 | Tomita et al. | 399/301 |
| 2008/0240754 | A1 * | 10/2008 | Kobayashi et al. | 399/46 |
| 2009/0252540 | A1 * | 10/2009 | Tomita et al. | 399/301 |

FOREIGN PATENT DOCUMENTS

| | | | |
|---|---|---|---|
| JP | 2004069801 | A * | 3/2004 |
| JP | 2006-281778 | | 10/2006 |

* cited by examiner

FIG. 8

| MARK No. | DIVERGENCE |
|---|---|
| 1 | −0.82 |
| 2 | −0.95 |
| 3 | −1.07 |
| 4 | −0.08 |
| 5 | −0.05 |
| 6 | 1.23 |
| 7 | 1.02 |
| 8 | 1.18 |
| 9 | 0.16 |
| 10 | 0.10 |
| 11 | 0.74 |
| 12 | 1.32 |
| 13 | 0.41 |
| 14 | −0.70 |
| 15 | −0.90 |
| 16 | −1.07 |

FIG. 9

| REGION SETTING No. | a−c | b−d | (a−c) −\|b−d\| |
|---|---|---|---|
| 1 | −5.24 | 5.65 | −10.89 |
| 2 | −4.72 | 7.09 | −11.81 |
| 3 | −1.73 | 6.20 | −7.93 |
| 4 | 2.00 | 6.09 | −4.09 |
| 5 | 5.65 | 5.24 | 0.41 |
| 6 | 7.09 | 4.72 | 2.37 |
| 7 | 6.20 | 1.73 | 4.47 |
| 8 | 6.09 | −2.00 | 4.09 |
| 9 | 5.24 | −5.65 | −0.41 |
| 10 | 4.72 | −7.09 | −2.37 |
| 11 | 1.73 | −6.20 | −4.47 |
| 12 | −2.00 | −6.09 | −8.09 |
| 13 | −5.65 | −5.24 | −10.89 |
| 14 | −7.09 | −4.72 | −11.81 |
| 15 | −6.20 | −1.73 | −7.93 |
| 16 | −6.09 | 2.00 | −8.09 |

IMAGE FORMING APPARATUS AND IMAGE FORMING ADJUSTMENT METHOD

CROSS-REFERENCE TO RELATED APPLICATIONS

This Nonprovisional application claims priority under 35 U.S.C. §119(a) on Patent Application No. 2005-282326 filed in Japan on Sep. 28, 2005, the entire contents of which are hereby incorporated by reference.

BACKGROUND OF THE INVENTION

The present invention relates to an image forming apparatus comprising multiple image carriers on which images with different color components are formed respectively, and driving means for rotating the image carriers, and to an image forming adjustment method, wherein multiple adjustment images are formed at a predetermined interval in an image forming region corresponding to the cycle length of one rotation of each image carrier, the divergence between the predetermined interval and the detection interval of each adjustment image is detected, the reference phases for the rotation of the respective image carriers are determined, and the driving, means is controlled so that the respective reference phases determined are aligned.

For example, an image forming apparatus in which, on black, cyan, magenta and yellow photoconductive drums, images with the respective color components are formed and transferred to a transfer belt so as to be superimposed is used as an apparatus that forms color images on sheets. In this apparatus, the laser beams outputted from multiple laser diodes corresponding to the respective photoconductive drums are reflected using multiple polygon mirrors corresponding to the respective photoconductive drums and applied to the respective photoconductive drums, thereby forming images with color components on the respective photoconductive drums. However, another apparatus is also used in which the laser beams outputted from multiple laser diodes are applied to a common polygon mirror, and the laser beams reflected using the polygon mirror are applied to the photoconductive drums respectively corresponding thereto. With this configuration, the number of the polygon mirrors is reduced.

This kind of image forming apparatus has a problem of causing low image quality owing to the divergences in the positions of the images with color components transferred to the transfer belt. For the purpose of solving this problem, image forming timing adjustment images (hereafter referred to as marks) are formed, the positions of the formed marks are detected, and image forming timing adjustment is carried out on the basis of the detected positions. The marks are formed such that marks for the color components, black, cyan, magenta and yellow, are formed on the transfer belt sequentially, and the mark forming timing is mainly determined by the output timing of the laser beams.

However, separately from the output timing of the laser beams, for example, owing to the fluctuation or the like in the rotation speed of the photoconductive drum caused by the eccentricity or the like of drive gears, there is a problem of causing divergences at the mark forming positions. Noise owing to the fluctuation in the rotation speed of the photoconductive drum has periodicity in many cases. For the purpose of solving this problem, the reference phases, each being used as the reference for one rotation (one cycle) of each photoconductive drum, are aligned (for example, refer to Japanese Patent Application Laid-open No. 2003-177588).

FIG. 1A is a conceptual view showing an example of a divergence between a reference position and a mark position, and FIG. 1B is a conceptual view showing an example of two kinds of mark positions whose reference phases are aligned. In FIGS. 1A and 1B, the reference positions are positions obtained by dividing the image forming region corresponding to the cycle length of one rotation of the photoconductive drum, on the surface of the drum, at equal intervals. Furthermore, although the marks are attempted to be formed at the reference positions, the positions at which the marks are formed are diverged owing to the fluctuation in the rotation speed or the like of the photoconductive drum. As shown in FIG. 1A, some marks are diverged in the movement direction, and others are diverged in the opposite direction. The divergence (being negative in the movement direction) of the mark with respect to the rotation phase of the photoconductive drum is ideally a sine curve. Hence, for example, it is possible that the center portion between the convex portion (positive peak) and the concave portion (negative peak) of the curve of the divergence is set as the reference phase. Because the reference phases of the respective photoconductive drums are aligned, the divergences at the mark formation positions owing to the fluctuation in the rotation speed or the like of the photoconductive drum are caused similarly, and the divergences at the formation positions become less conspicuous as shown in FIG. 1B.

BRIEF SUMMARY OF THE INVENTION

However, in the case that the divergence curve is such an ideal sine curve as shown in FIG. 1A, its positive and negative peaks can be detected accurately. However, in reality, the divergence curve is not an ideal sine curve because of the occurrence of distortions or the like. Furthermore, the positive and negative peaks are detected erroneously in many cases. Hence, there is a problem of being difficult to accurately obtain the reference phase stably.

In consideration of these circumstances, an object of the present invention is to provide an image forming apparatus and an image forming adjustment method wherein two regions, being away from each other by a half cycle length, in which the difference between the divergence amounts is maximum are decided in an image forming region corresponding to the cycle length of one rotation of an image carrier, and the reference phase for the rotation of the image carrier is determined on the basis of the two regions decided, whereby the reference phase can be determined accurately.

In addition, another object of the present invention is to provide an image forming apparatus and an image forming adjustment method wherein the image forming region is divided into four or more even numbered divided regions, the divergence amount of each divided region is calculated, and the maximum portions of the divergences are determined on the basis of the divergence amounts of divided regions being away from each other by a half cycle length, whereby the reference phase on the basis of the maximum portions can be determined accurately.

Furthermore, still another object of the present invention is to provide an image forming apparatus and an image forming adjustment method wherein the maximum portions are determined on the basis of divided regions, being away from each other by a half cycle length, in which the difference between the divergence amounts is maximum, whereby the maximum portions can be determined accurately.

Moreover, yet still another object of the present invention is to provide an image forming apparatus and an image forming adjustment method wherein the maximum portions are determined on the basis of the divided regions in which the difference between the difference between the divergence amounts of divided regions being away from each other by a half cycle length and the absolute value of the difference between the divergence amounts of divided regions being away from the above-mentioned divided regions by a quarter cycle length and being away from each other by a half cycle is maximum, whereby the maximum portions can be determined accurately.

Besides, a further object of the present invention is to provide an image forming apparatus and an image forming adjustment method wherein the setting positions of the divided regions in the image forming region are changed, and the divergence amounts of the respective divided regions having different setting positions are calculated, whereby the maximum portions can be determined more accurately.

An image forming apparatus according to the present invention, equipped with multiple image carriers on which images with different color components are formed respectively, and driving means for rotating the image carriers, wherein multiple adjustment images are formed at a predetermined interval in an image forming region corresponding to the cycle length of one rotation of each image carrier, the divergence between the predetermined interval and the detection interval of each adjustment image is detected, the reference phases for the rotation of the respective image carriers are determined, and the driving means is controlled so that the respective reference phases determined are aligned, comprising deciding means for deciding two regions, being away from each other by a half cycle length, in which the difference between the divergence amounts is maximum in the image forming region, and determining means for determining the reference phase on the basis of the two regions decided by the deciding means.

An image forming adjustment method according to the present invention, wherein multiple image carriers on which images with different color components are formed respectively are rotated using driving means, multiple adjustment images are formed at a predetermined interval in an image forming region corresponding to the cycle length of one rotation of each image carrier, the divergence between the predetermined interval and the detection interval of each adjustment image is detected, the reference phases for the rotation of the respective image carriers are determined, and the driving means is controlled so that the respective reference phases determined are aligned, comprising the step of deciding two regions, being away from each other by a half cycle length, in which the difference between the divergence amounts is maximum in the image forming region, and the step of determining the reference phase on the basis of the two regions decided.

With the present invention, two regions, being away from each other by a half cycle length, in which the difference between the divergence amounts is maximum, are decided in the image forming region corresponding to the cycle length of one rotation of the image carrier, the reference phase is determined on the basis of the two regions decided. Hence, the maximum portions of divergences (the region including the peak value (positive peak) of the divergences of the detection intervals of the respective adjustment images in the positive direction on the basis of the predetermined interval and the region including the peak value (negative peak) of the divergences in the negative direction) can be detected accurately, and the reference phase can be determined accurately on the basis of the regions. The divergences of the adjustment images along the cycle length of one rotation of the image carrier form a periodic curve having a convex portion (positive peak) and a concave portion (negative peak) in many cases. However, it is assumed that the region including a positive peak and the region including a negative peak are away from each other by a half cycle length, and that the difference between the divergence amounts in the two regions is larger than the difference between the divergence amounts in the other two regions and is maximum. Hence, the two regions, being away from each other by a half cycle length, in which the difference between the divergence amounts is maximum, can be detected as the region including the positive peak and the region including the negative peak of the divergence amounts. For example, the total divergences of the respective adjustment images included in the regions can herein be used as the divergence amounts. Furthermore, the reference phase can be determined at the positive peak or the negative peak of the divergences or the center value of the positive peak and the negative peak, for example.

An image forming apparatus according to the present invention, equipped with multiple image carriers on which images with different color components are formed respectively, and driving means for rotating the image carriers, wherein multiple adjustment images are formed at a predetermined interval in an image forming region corresponding to the cycle length of one rotation of each image carrier, the reference phases for the rotation of the respective image carriers are determined on the basis of maximum portions of the divergences between the predetermined interval and the detection interval of each adjustment image, and the driving means is controlled so that the respective reference phases determined are aligned, comprising calculating means for dividing the image forming region into four or more even numbered divided regions and calculating the divergence amount of each divided region, and determining means for determining the maximum portions on the basis of the divergence amount of the divided regions being away from each other by a half cycle length.

An image forming adjustment method according to the present invention, wherein multiple image carriers on which images with different color components are formed respectively are rotated using driving means, multiple adjustment images are formed at a predetermined interval in an image forming region corresponding to the cycle length of one rotation of each image carrier, the reference phases for the rotation of the respective image carriers are determined on the basis of maximum portions of the divergences between the predetermined interval and the detection interval of each adjustment image, and the driving means is controlled so that the respective reference phases determined are aligned, comprising the step of dividing the image forming region into four or more even-numbered divided regions and calculating the divergence amount of each divided region, and the step of determining the maximum portions on the basis of the divergence amounts of the divided regions being away from each other by a half cycle length.

With the present invention, the image forming region corresponding to the cycle length of one rotation of the image carrier is divided into four or more even-numbered divided regions and the divergence amount of each divided region is calculated using the calculating means, and the maximum portions (the region including a positive peak and the region including a negative peak) of the divergences are determined using the determining means on the basis of the divergence amounts of regions being away from each other by a half cycle length, whereby the maximum portions of the divergences at the forming positions can be determined accurately. Because the divergence amounts are calculated for the respective divided regions, the divergence amounts are hardly affected by the formation errors or detection errors of the respective adjustment images. For this reason, the divided region including the positive peak and the divided region including the negative peak can be detected accurately. Hence, the reference phases for the respective carriers can be determined accurately, and the reference phases for the respective carriers can be aligned accurately. For example, the total divergences of the respective adjustment images included in the divided regions can herein be used as the divergence amounts. Furthermore, the reference phase can be determined at the positive peak or the negative peak of the divergences or the center value of the positive peak and the negative peak, for example.

On the basis of the divided regions, being away from each other by a half cycle length, in which the difference between the divergence amounts is maximum, the maximum portions are determined. Hence, the maximum portions can be determined accurately. The divergences of the adjustment images in the cycle length of one rotation of the image carrier (the divergence between the predetermined interval and the detection interval of each adjustment image) form a periodic curve having a convex portion (positive peak) and a concave portion (negative peak) in many cases. However, it is assumed that the divided region including a positive peak and the divided region including a negative peak are away from each other by a half cycle length, and that the difference between the divergence amounts of the divided regions is larger than the difference between the divergence amounts of the other divided regions and is maximum. Hence, the two regions, being away from each other by a half cycle length, in which the difference between the divergence amounts is maximum, can be detected as the region including the positive peak and the region including the negative peak of the divergence amounts.

The image forming region is divided into divided regions, the number of which is a multiple of four, and the divergence amount of each divided region is calculated. The maximum portions are determined on the basis of the divided regions in which the difference between the difference between the divergence amounts of divided regions being away from each other by a half cycle length and the absolute value of the difference between the divergence amounts of divided regions being away from the above-mentioned divided regions by a quarter cycle length and being away from each other by a half cycle is maximum. Hence, the maximum portions can be determined accurately. The divergences of the adjustment images in the cycle length of one rotation of the image carrier (the divergence between the predetermined interval and the detection interval of each adjustment image) form a periodic curve having a convex portion (positive peak) and a concave portion (negative peak) in many cases. However, it is assumed that the divided region including a positive peak and the divided region including a negative peak are away from each other by a half cycle length, and that the difference between the divergence amounts of the divided regions is larger than the difference between the divergence amounts of the other divided regions and is maximum. Furthermore, it is assumed that center points at which the amplitude is zero are included in the divided regions, being away from the divided region having a positive peak and the divided region having a negative peak by a quarter cycle length, and being away from each other by a half cycle length, and that the difference between the divergence amounts of the divided regions is smaller than the difference between the divergence amounts of the other divided regions and is minimum.

The setting positions of the divided regions in the image forming region are changed, and the divergence amounts of the respective divided regions having different setting positions are calculated. Hence, the maximum portions can be determined more accurately. The divergences of the adjustment images in the cycle length of one rotation of the image carrier (the divergence between the predetermined interval and the detection interval of each adjustment image) form a periodic curve having a convex portion (positive peak) and a concave portion (negative peak) in many cases. However, it is assumed that the divided region including a positive peak and the divided region including a negative peak are away from each other by a half cycle length. In the case that the setting positions of the divided regions are changed, in the divided region including the positive peak and the divided region including the negative peak, the positions of the positive peak and the negative peak included in the divided regions are changed. However, it is preferable that the positive peak and the negative peak should be included near the centers of the divided regions. In this case, the difference between the divergence amounts of the divided region including the positive peak and the divided region including the negative peak is maximum, and the difference between the divergence amounts of the divided regions including the center points and being away from each other by a half cycle length is minimum. Hence, the divided region including the positive peak and the divided region including the negative peak can be detected accurately in the state that the positive peak and the negative peak are located near the centers of the divided regions, and the maximum portions can be determined more accurately.

BRIEF DESCRIPTION OF THE SEVERAL VIEWS OF THE DRAWINGS

FIG. 8 is a table showing examples of the divergence detection values at 16 marks;

FIG. 9 is a table showing the calculation results of a−c, b−d, and (a−c)−|b−d| on the basis of the total divergences a, b, c and d;

DETAILED DESCRIPTION OF THE INVENTION

The present invention will be described below specifically on the basis of the drawings showing the embodiment thereof.

Figure 2:
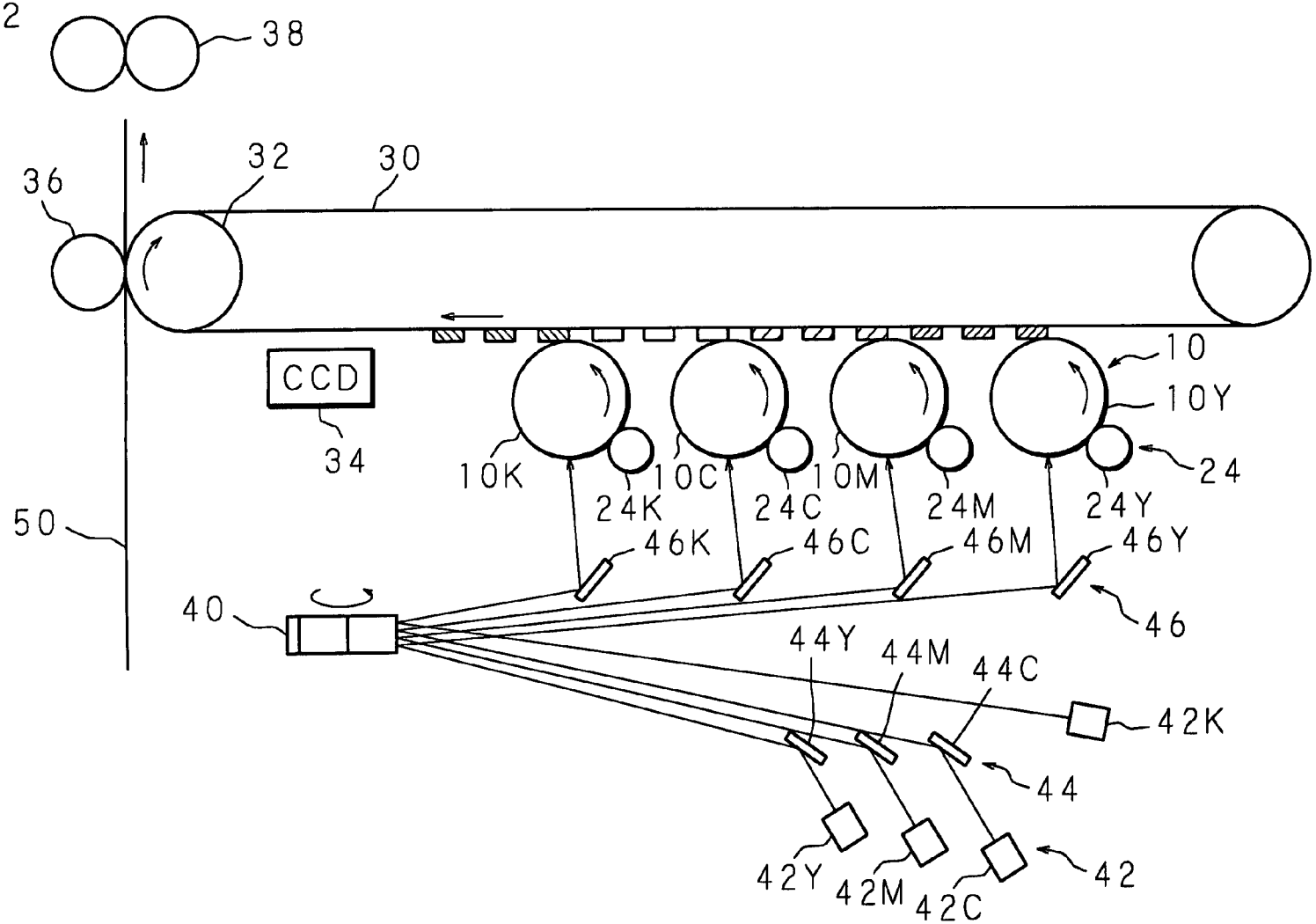
FIG. 2 is a schematic view showing the configuration of the main sections of an image forming apparatus according to the present invention.

FIG. 2 is a schematic view showing the configuration of the main sections of an image forming apparatus according to the present invention. The image forming apparatus mainly comprises a photoconductive drum (image carrier) 10 on which images are formed, a laser diode 42 that outputs a laser beam, a first mirror 44 that guides the laser beam outputted from the laser diode 42 to the photoconductive drum 10, a polygon mirror 40, a second mirror 46, a developing roller 24 that develops latent images formed on the photoconductive drum 10 using the laser beam, and a transfer belt 30 that transfers the images formed on the photoconductive drum 10.

The photoconductive drum 10 comprises a black photoconductive drum 10K, a cyan photoconductive drum 10C, a magenta photoconductive drum 10M and a yellow photoconductive drum 10Y. Similarly, the developing roller 24 comprises a black developing roller 24K, a cyan developing roller 24C, a magenta developing roller 24M and a yellow developing roller 24Y. Furthermore, the laser diode 42 comprises a black laser diode 42K, a cyan laser diode 42C, a magenta laser diode 42M and a yellow laser diode 42Y.

The first mirror 44 comprises a cyan first mirror 44C, a magenta first mirror 44M and a yellow first mirror 44Y that guide the laser beams outputted from the cyan laser diode 42C, the magenta laser diode 42M and the yellow laser diode 42Y, respectively, to the polygon mirror 40. Furthermore, the second mirror 46 comprises a black second mirror 46K, a cyan second mirror 46C, a magenta mirror 46M and a yellow second mirror 46Y that guide the laser beams reflected using the polygon mirror 40 to the black photoconductive drum 10K, the cyan photoconductive drum 10C, the magenta photoconductive drum 10M and the yellow photoconductive drum 10Y, respectively. With this combination of the multiple mirrors, the irradiation positions (beam spots) of the laser beams applied from the multiple laser diodes 42C, 42M and 42Y disposed at intervals can be brought close to one another, and the laser beams can be applied to the same reflective surface of the polygon mirror 40.

The transfer belt 30 has a loop shape, and the photoconductive drums 10K, 10C, 10M and 10Y for the respective color components are arranged in a row so as to be opposed to the surface of the transfer belt 30. In addition, the images transferred to the transfer belt 30 are moved to from the right to the left in the figure with respect to the photoconductive drum 10 using a belt drive roller 32 that internally makes contact with the transfer belt 30. Furthermore, a CCD (charge coupled device) 34 is disposed so as to be opposed to the surface of the transfer belt 30. The CCD 34 is disposed on the downstream side of the movement direction of the transfer belt 30 from the photoconductive drum 10. Moreover, the black photoconductive drum 10K, the cyan photoconductive drum 10C, the magenta photoconductive drum 10M and the yellow photoconductive drum 10Y constituting the photoconductive drum 10 are disposed in this order on the upstream side of the movement direction of the transfer belt 30 from the CCD 34.

Furthermore, a transfer roller 36 is disposed so as to be opposed to the belt drive roller 32 with the transfer belt 30 being held therebetween. The images on the transfer belt 30 are transferred to a sheet 50 passing through the transfer roller 36 and fixed using fixing rollers 38.

Figure 3:
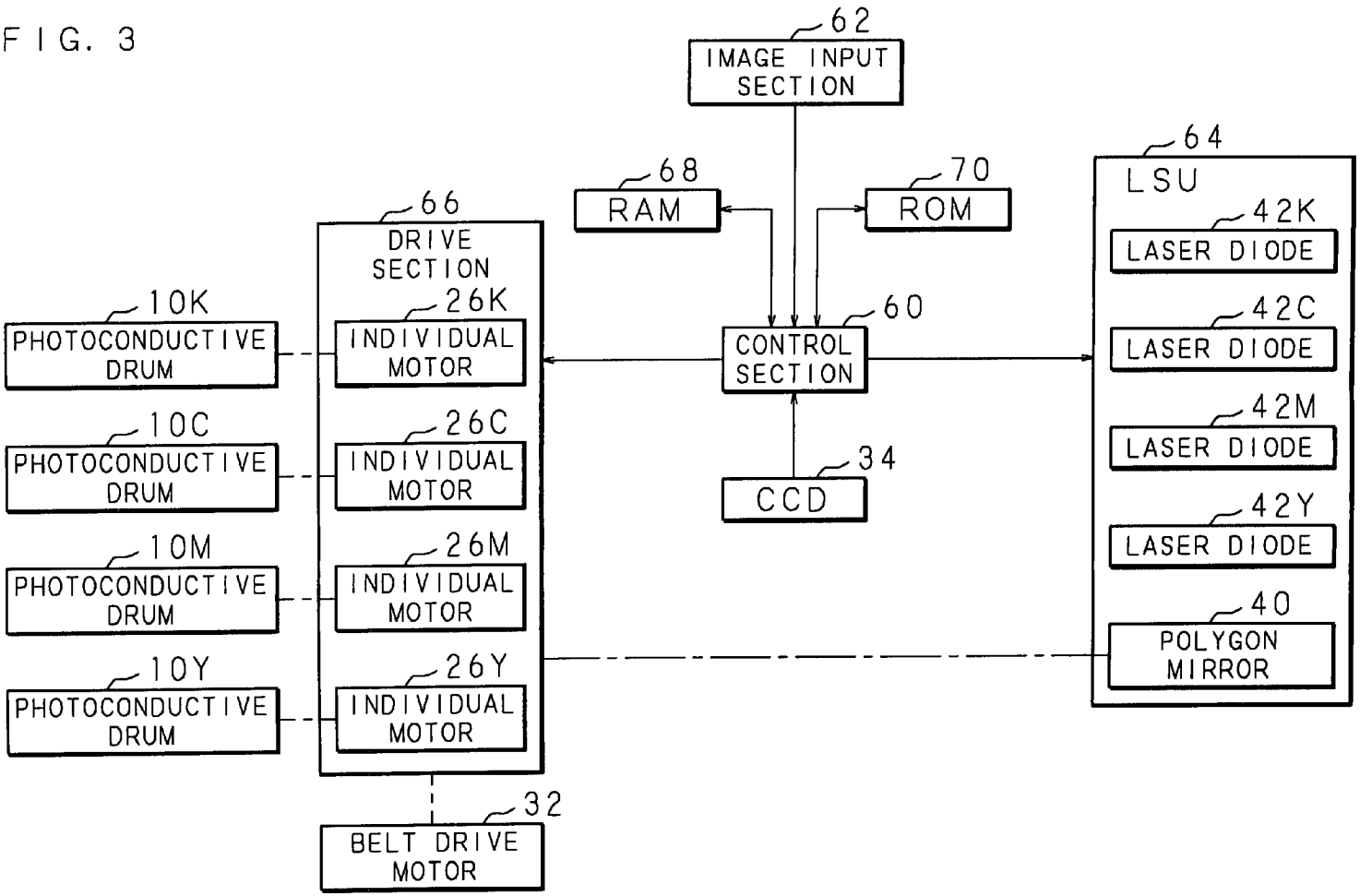
FIG. 3 is a block diagram showing the configuration of the main sections of the image forming apparatus.

FIG. 3 is a block diagram showing the configuration of the main sections of the image forming apparatus. The image forming apparatus comprises an LSU (laser scanning unit) 64 having the laser diodes 42K, 42C, 42M and 42Y, and the polygon mirror 40; the CCD 34 that detects adjustment images (hereafter referred to as marks) for adjusting image forming timing or reference phases, for example; a drive section (driving means) 66 that drives the photoconductive drum 10, the belt drive roller 32 and the polygon mirror 40; an image input section 62 that reads images from manuscripts, such as an image scanner; a control section 60 formed of a CPU (central processing unit), for example, connected to the CCD 34, the LSU 64, the drive section 66 and the image input section 62 described above; and a RAM 68 and a ROM 70 connected to the control section 60. The control section 60 controls the respective sections inside the apparatus on the basis of programs and data stored in the ROM 70.

Figure 4:
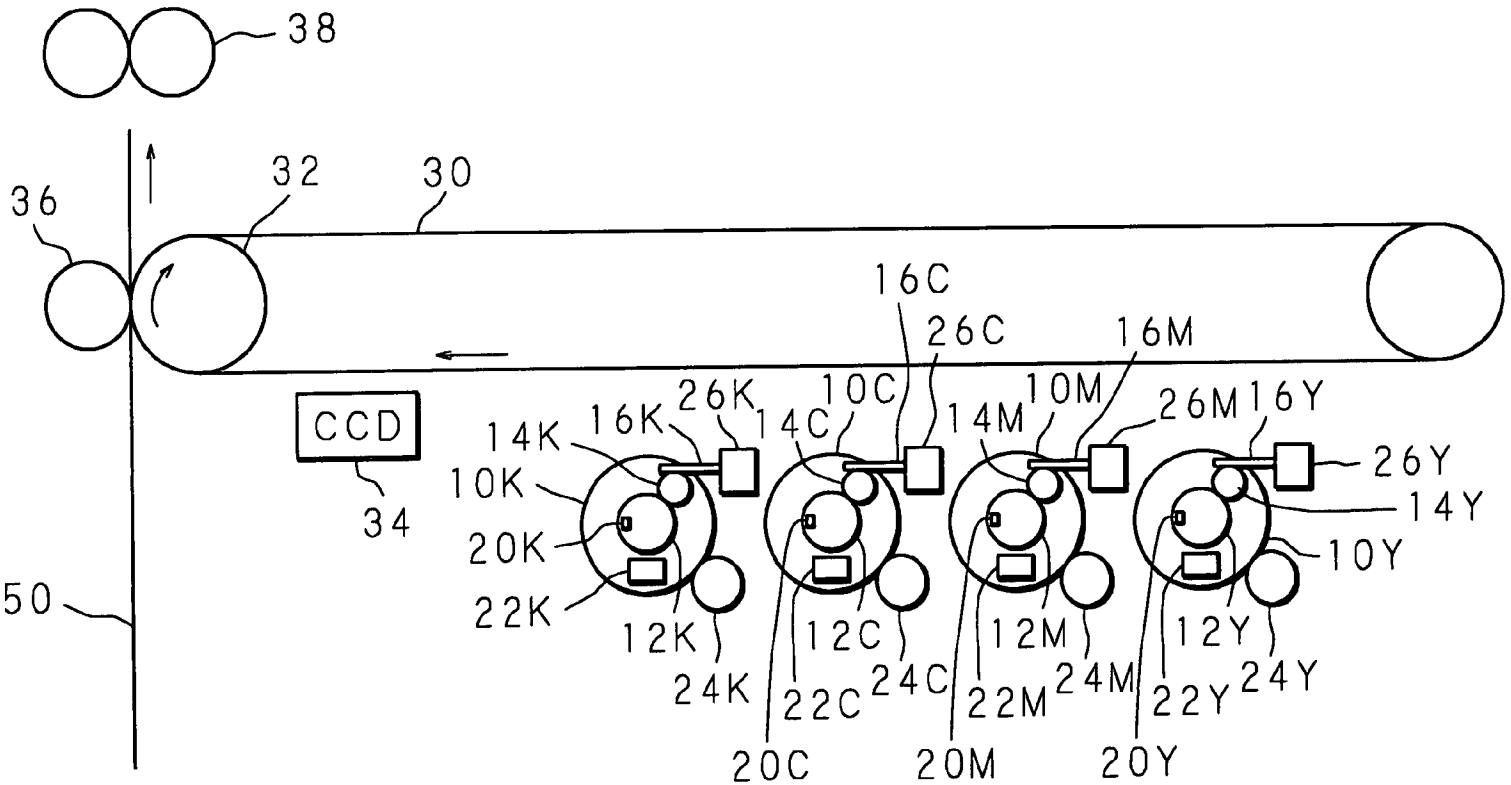
FIG. 4 is a schematic view showing a configuration example of photoconductive drums and motors that drive the photoconductive drums.

The drive section 66 comprises a motor that drives the polygon mirror 40, a motor that drives the belt drive roller 32, and individual motors (driving means) 26K, 26C, 26M and 26Y that drive the photoconductive drums 10K, 10C, 10M and 10Y, respectively. FIG. 4 is a schematic view showing a configuration example of the photoconductive drums and the motors that drive the photoconductive drums. The photoconductive drums 10K, 10C, 10M and 10Y are provided with shaft gears 12K, 12C, 12M and 12Y, serving as rotation centers, and worm wheels 14K, 14C, 14M and 14Y meshed with the shaft gears 12K, 12C, 12M and 12Y, respectively. Furthermore, worms 16K, 16C, 16M and 16Y driven using the individual motors 26K, 26C, 26M and 26Y are meshed with the worm wheels 14K, 14C, 14M and 14Y, respectively.

The shaft gears 12K, 12C, 12M and 12Y are provided with ribs 20K, 20C, 20M and 20Y, respectively, and the photoconductive drums 10K, 10C, 10M and 10Y are provided with rib sensors 22K, 22C, 22M and 22Y, respectively. The rib sensors 22K, 22C, 22M and 22Y each have a light emitting section and a light receiving section, and can detect that the ribs 20K, 20C, 20M and 20Y pass through the space between the light emitting section and the light receiving section, and that the light is shielded.

The LSU 64 operates as an image forming means that forms a reference mark for black (reference color) being used as a reference and adjustment marks for cyan, magenta and yellow (adjustment colors) to be adjusted, on the photoconductive drums 10K, 10C, 10M and 10Y respectively corresponding to the color components. The CCD 34 and the control section 60 detect the positions of the respective marks transferred to the transfer belt 30. The control section 60 controls the LSU 64 so that the divergence of the detection position of each adjustment mark from its specified position on the basis of the reference mark is equal to or less than a predetermined value, thereby adjusting the timing of image formation. The predetermined value differs depending on the color component. For example, the predetermined value for yellow is the largest, and the predetermined value for magenta is the smallest.

The control section 60 adjusts the forming timing for cyan so that the distance between the reference mark (black) and the cyan adjustment mark is within a specified distance range. Similarly, the control section 60 adjusts the forming timing for magenta so that the distance between the reference mark (black) and the magenta adjustment mark is within a specified distance range, and adjusts the forming timing for yellow so that the distance between the reference mark (black) and the yellow adjustment mark is within a specified distance range. As the position of the image of each color component, the average value of the leading end position and the trailing end position in the movement direction of each mark detected using the CCD 34 is obtained by the control section 60 and stored in the RAM 68. The stored average value is used as the position of the mark. The position of the mark is represented by the time detected by the CCD 34.

In addition, the photoconductive drum 10 is cylindrical. The control section 60 detects the reference phase of the rotation of each photoconductive drum (image carrier) 10 and adjusts the timing of image formation so that the reference phase of the reference color and the reference phase of each adjustment color are aligned. The reference phase can be set as the time elapsed after the rib sensor 22 has detected the rib. Because the photoconductive drum 10 and the belt drive roller 32 are rotated at a constant speed, the difference between the reference phases or the distance between the marks can be represented by time or length.

Figure 1A:
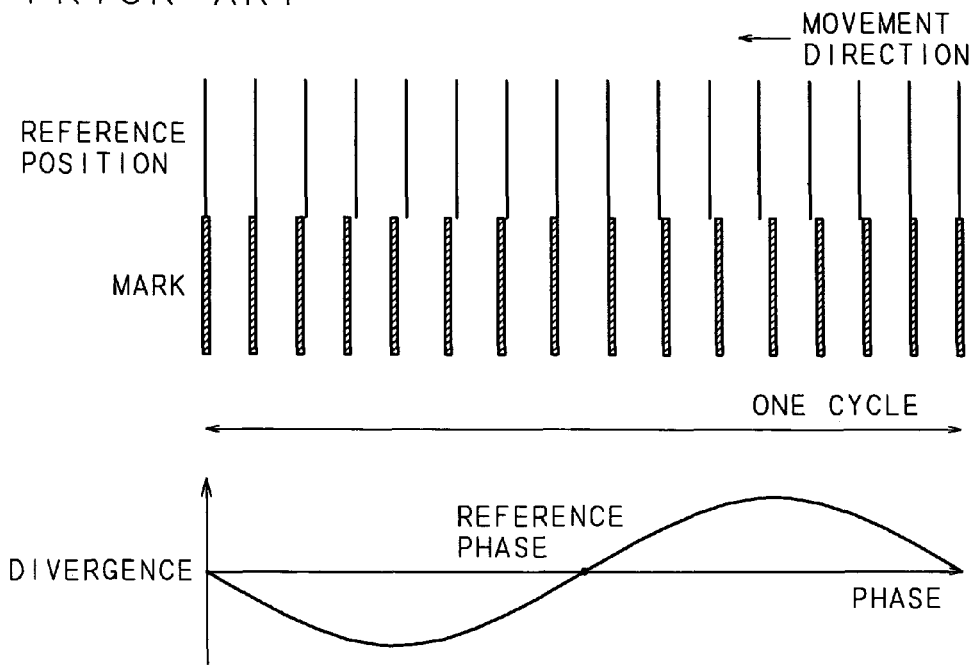
FIG. 1A PRIOR ART
FIG. 1A is a conceptual view showing an example of a divergence between a reference position and a mark position.
Figure 1B:
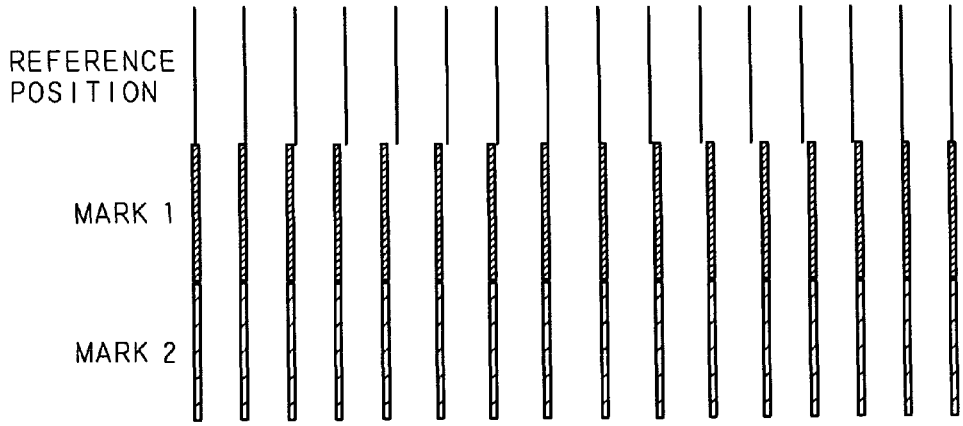
FIG. 1B PRIOR ART
FIG. 1B is a conceptual view showing an example of two kinds of mark positions whose reference phases are aligned.

In the case that the reference phases are detected, multiple reference marks and multiple adjustment marks are formed for each color at a predetermined interval in an image forming region corresponding to one cycle length (the cycle length of one rotation) of the photoconductive drum 10 under the control of the control section 60. For example, as shown in FIG. 1A, 16 marks are formed along one cycle length. The CCD 34 and the control section 60 detect the reference marks and the adjustment marks for each color, and calculate the divergence between the detection position where each mark is actually detected and the reference position where the mark should be formed, and stores the calculated respective divergences in the RAM 68. In this description, it is assumed that the movement direction is negative and that a divergence in the movement direction is represented by a negative value. The divergence between the detection position of each mark and the reference position of the mark can be represented by the difference between the time when the mark is detected and the time when the mark should be detected. The interval between the marks can be represented not only by time but also by the distance corresponding to the time or by the number of dots corresponding to the time.

Figure 5:
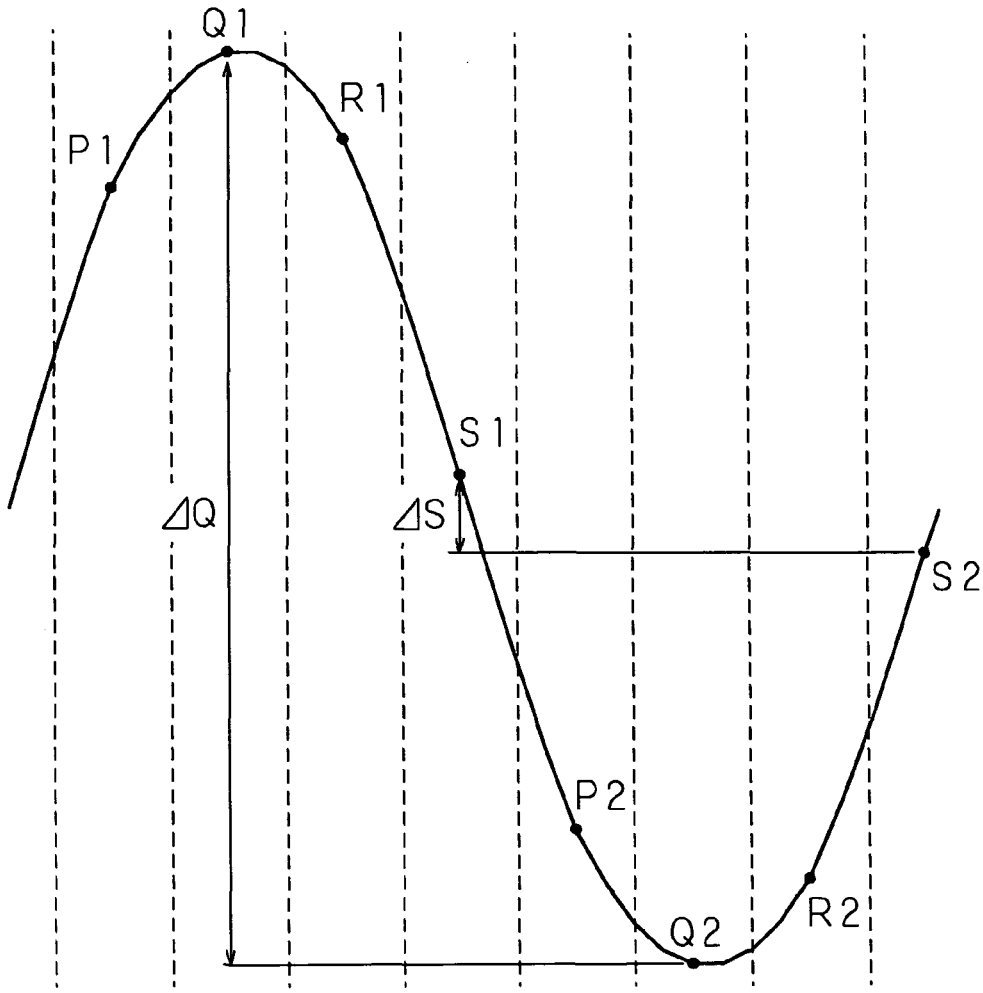
FIG. 5 is an explanatory view simply showing examples of the divergence amounts of regions being away from each other by a half cycle length.

The control section 60 operates as a calculating section that divides the image forming region corresponding to the one cycle length of the photoconductive drum 10 into four or more even-numbered regions (divided regions) and calculates the divergence amount of each region, and also operates as a determining section that determines the maximum portions (positive and negative peaks) of the mark divergences on the basis of the divergence amounts of the regions being away from each other by a half cycle length. FIG. 5 is an explanatory view simply showing examples of the divergence amounts of the regions being away from each other by a half cycle length. In the examples shown in the figure, a curve for one cycle is divided into eight regions, and the divergence amounts of the respective regions are simply represented by divergences P1, Q1, R1, S1, P2, Q2, R2 and S2. The divergences P1 and P2 are away from each other by a half cycle. The divergences Q1 and Q2, the divergences R1 and R2, and the divergence S1 and S2 are also away from each other by a half cycle. Regarding the respective differences between the divergences being away from each other by a half cycle, that is, $\Delta P=|P1-P2|$, $\Delta Q=|Q1-Q2|$, $\Delta R=|R1-R2|$ and $\Delta S=|S1-S2|$, the absolute value ($\Delta Q$ in the examples shown in the figure) of the difference between the divergence in a region close to the convex portion (positive peak) of the curve and the divergence in a region close to the concave portion (negative peak) of the curve is maximum, and the absolute value ($\Delta S$ in the examples shown in the figure) of the difference between the divergences in regions close to the center of the curve is minimum as shown in FIG. 5. Hence, the maximum portions (positive and negative peaks) of the curve and the center portion of the curve can be determined on the basis of the difference between the divergences of the regions being away from each other by a half cycle.

Figure 6A:
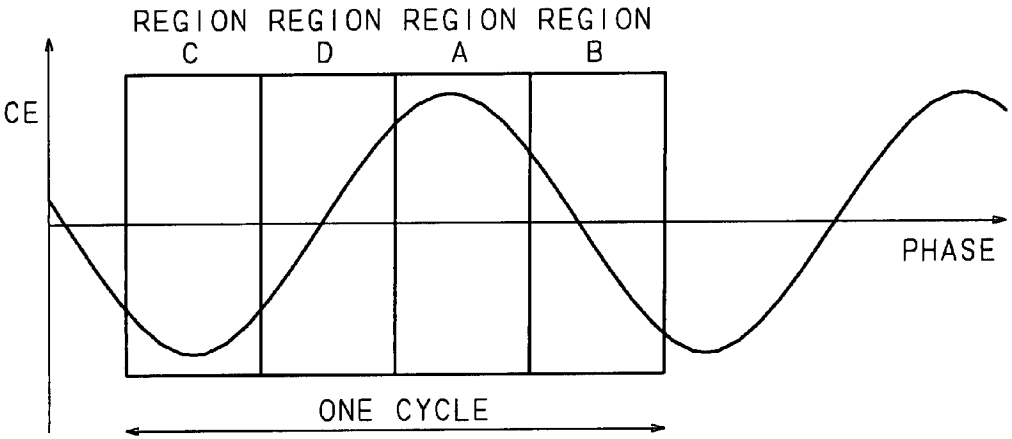
FIGS. 6A and 6B are conceptual views showing the setting examples of the regions.
Figure 6B:
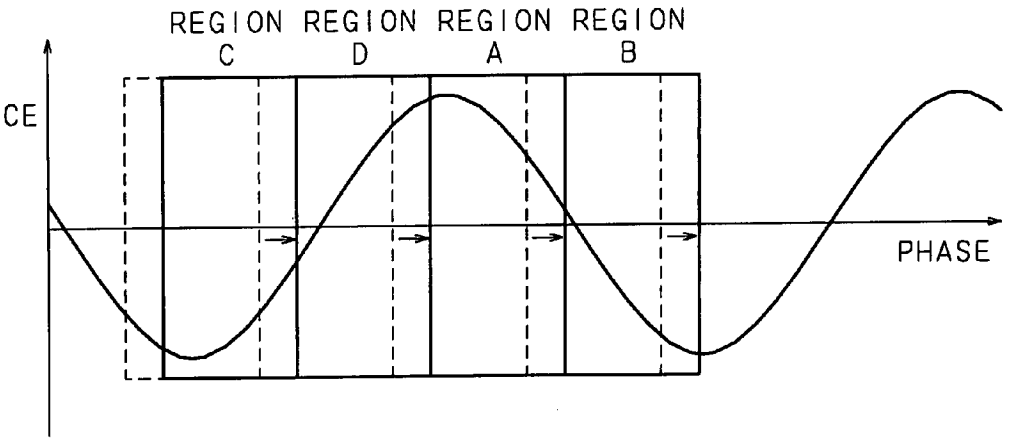

In this embodiment, for the divergence curve shown in FIG. 1A, four regions, A, B, C and D, are set at equal intervals in the image forming region corresponding to the one cycle length (the cycle length of one rotation) of the photoconductive drum 10. The region A is at the head. FIGS. 6A and 6B are conceptual views showing the setting examples of the regions. The "phase" on the horizontal axis of the graph showing the curve represents time corresponding to the rotation angle of the photoconductive drum, and the "divergence" on the vertical axis represents time corresponding to the divergence between the reference position and the mark.

Furthermore, in this embodiment, the total (hereafter referred to as total divergence) of divergences in each of the regions A, B, C and D is calculated as each of divergence amounts a, b, c and d. As shown in FIG. 6A, the total divergence (divergence amount) is maximum in a region including a convex portion (positive peak) of the divergence curve and is minimum in a region including a concave portion (negative peak) thereof. In each of the other regions, the total divergence has a center value between the maximum and minimum. Hence, it is possible that the region having the maximum total divergence is selected as the region including the positive peak and that the region having the minimum total divergence is selected as the region including the negative peak, from the four regions.

However, as shown in FIG. 6A, each of the positive peak and the negative peak of the curve is located near the center of a region in some cases, or as shown in FIG. 6B, each of the positive peak and the negative peak of the curve is located near the end of the region in other cases. Hence, the control section (deciding section, determining section) 60 calculates the total divergence in each region in the case that the setting position of the region is changed, decides two regions, being away from each other by a half cycle length, in which the difference between the divergence amounts is maximum, and determines reference phases on the basis of the two regions decided. In this embodiment, 16 marks are formed along the cycle length of one rotation of the photoconductive drum 10, and 16 region settings are carried out so that each mark is located at the head of the region A.

Figure 7:
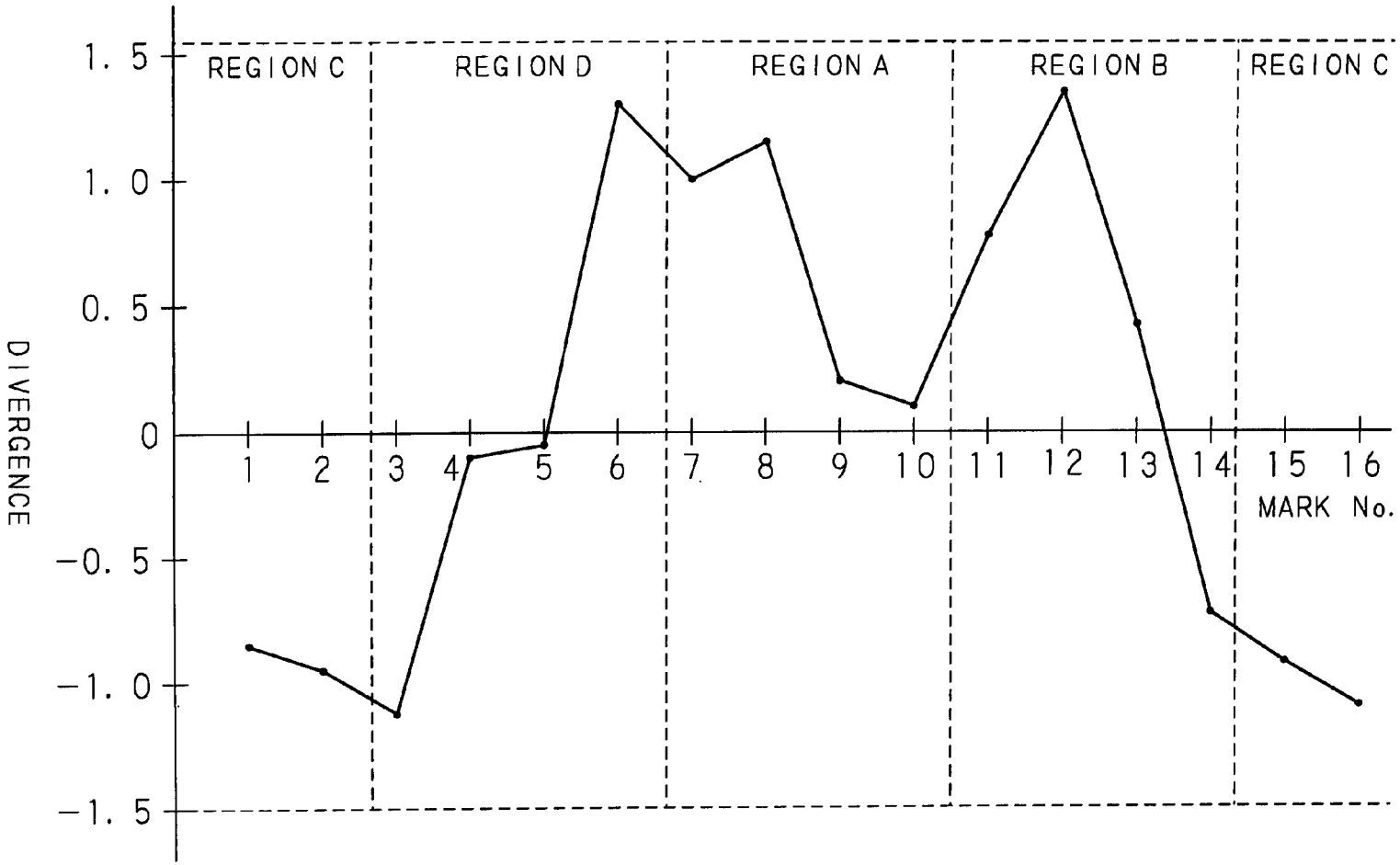
FIG. 7 is a view showing examples of the divergence detection values at 16 marks.

In the following description, the detected 16 marks are represented by mark Nos. 1 to 16 in the order of detection. In addition, it is described that the setting of a region wherein the head of the region A is represented by mark No. n (n=1 to 16) is setting No. n. For example, in region setting No. 1, mark Nos. 1 to 4 are set in the region A, mark Nos. 5 to 8, mark Nos. 9 to 12 and mark Nos. 13 to 16 are set in the regions B, C and D, respectively. Next to mark No. 16, the setting is returned, and No. 1 is used. FIG. 7 is a view showing examples of the divergence detection values at the 16 marks. In the examples in the figure, region setting No. 7 is shown, and the head of the region A is mark No. 7. Furthermore, FIG. 8 shows the divergence values at the respective marks. Although the unit of divergence is dot, time (1 dot=0.341 ms) or distance (1 dot=0.0423 mm) can also be used as a unit.

The control section 60 determines the maximum divergence portions (the region including the positive peak and the region including the negative peak) on the basis of the regions in which the difference between the difference between the total divergences in the regions being away from each other by a half cycle length and the absolute value of the difference between the total divergences in the regions being away from the above-mentioned regions by a quarter cycle length and being away from each other by a half cycle is maximum. Furthermore, the control section 60 determines the reference phases on the basis of the maximum portions. Moreover, in each region setting, as shown in FIG. 6A, in the case that the positive peak and the negative peak of the curve are included in the centers of the regions A and C, respectively, the difference between the total divergences of the regions A and C, that is, (a−c), is maximum, and the absolute value of the difference between the total divergences of the regions B and D, that is, |b−d|, is minimum. Hence, from among the region setting Nos. 1 to 16, the control section 60 selects the setting in which (a−c)−|b−d| is maximum. In the selected region setting, the control section 60 determines the phase corresponding to the detection position of the center mark among the marks included in the region D (or the region B) between the region A and the region C as the reference phase. In the case that two center marks are present, it is possible to obtain the average of the phases corresponding to the detection positions or it is possible to determine that the phase corresponding to the detection position at which the divergence is closer to zero is the reference phase. Still further, it is also possible to determine that the phase corresponding to the detection position at the center mark among the marks included in the region A (or the region C) is the reference phase.

FIG. 9 shows the calculation results of a−c, b−d, and (a−c)−|b−d on the basis of the total divergences a, b, c and d obtained from the divergences listed in FIG. 8. In the examples shown in FIG. 9, region setting No. 7 wherein (a−c)−|b−d| is maximum is selected. Furthermore, the phase corresponding to the detection position at mark No. 5 selected from among the center mark Nos. 4 and 5 in the region D, at which the divergence is closer to zero, is determined as the reference phase.

Figure 10:
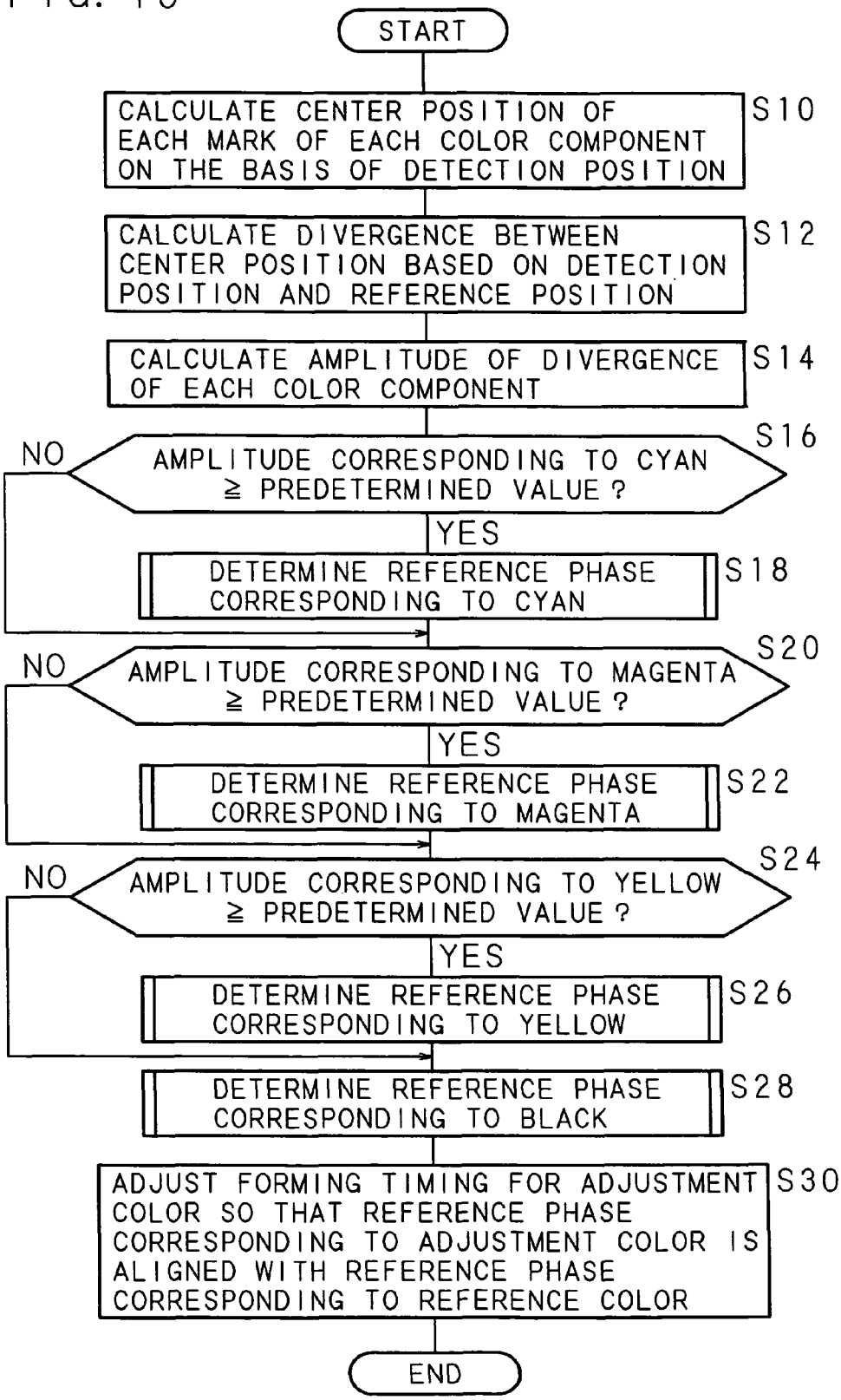
FIG. 10 is a flowchart showing an example of an image forming timing adjustment procedure regarding the reference phases.

FIG. 10 is a flowchart showing an example of an image forming timing adjustment procedure regarding the reference phases. Under the control of the control section 60, multiple reference marks and multiple adjustment marks are formed for each color at predetermined intervals. In this embodiment, 16 marks are formed at equal intervals along the cycle length of one rotation of the photoconductive drum 10. The control section 60 detects the leading end positions and trailing end positions of the marks of each color component from the image fed from the CCD 34 and formed on the surface of the transfer belt 30, calculates the center position of each mark on the basis of the detection position (at step S10), and stores the center position in the RAM 68. For each of the reference mark (black) and the other color components (cyan, magenta and yellow), the control section 60 calculates the divergence between each center position calculated on the basis of the detection position and the reference position at which the mark should be formed (at step S12), and stores the divergence in the RAM 68. Furthermore, the control section 60 obtains the amplitude (half of the peak-to-peak value) of the divergence of each color component (at step S14), and stores the amplitude in the RAM 68.

In the case that the amplitude corresponding to cyan is equal to or more than a predetermined value (YES at step S16), the reference phase corresponding to cyan is determined (at step S18) and stored in the RAM 68. In the case that the amplitude corresponding to magenta is equal to or more than a predetermined value (YES at step S20), the reference phase corresponding to magenta is determined (at step S22) and stored in the RAM 68. In the case that the amplitude corresponding to yellow is equal to or more than a predetermined value (YES at step S24), the reference phase corresponding to yellow is determined (at step S26) and stored in the RAM 68. Then, the reference phase corresponding to black is determined (at step S28) and stored in the RAM 68. For an adjustment color, the reference phase of which is determined, the forming timing for the adjustment color is adjusted so that the reference phase corresponding to the adjustment color is aligned with the reference phase corresponding to the reference color (at step S30). With this procedure, even if a cyclic color divergence owing to the eccentricity of the photoconductive drum occurs between the reference color and the adjustment color, the timing is adjusted so that the color divergence occurs in the same cycle, whereby the color divergence is suppressed so as not be conspicuous.

Figure 11:
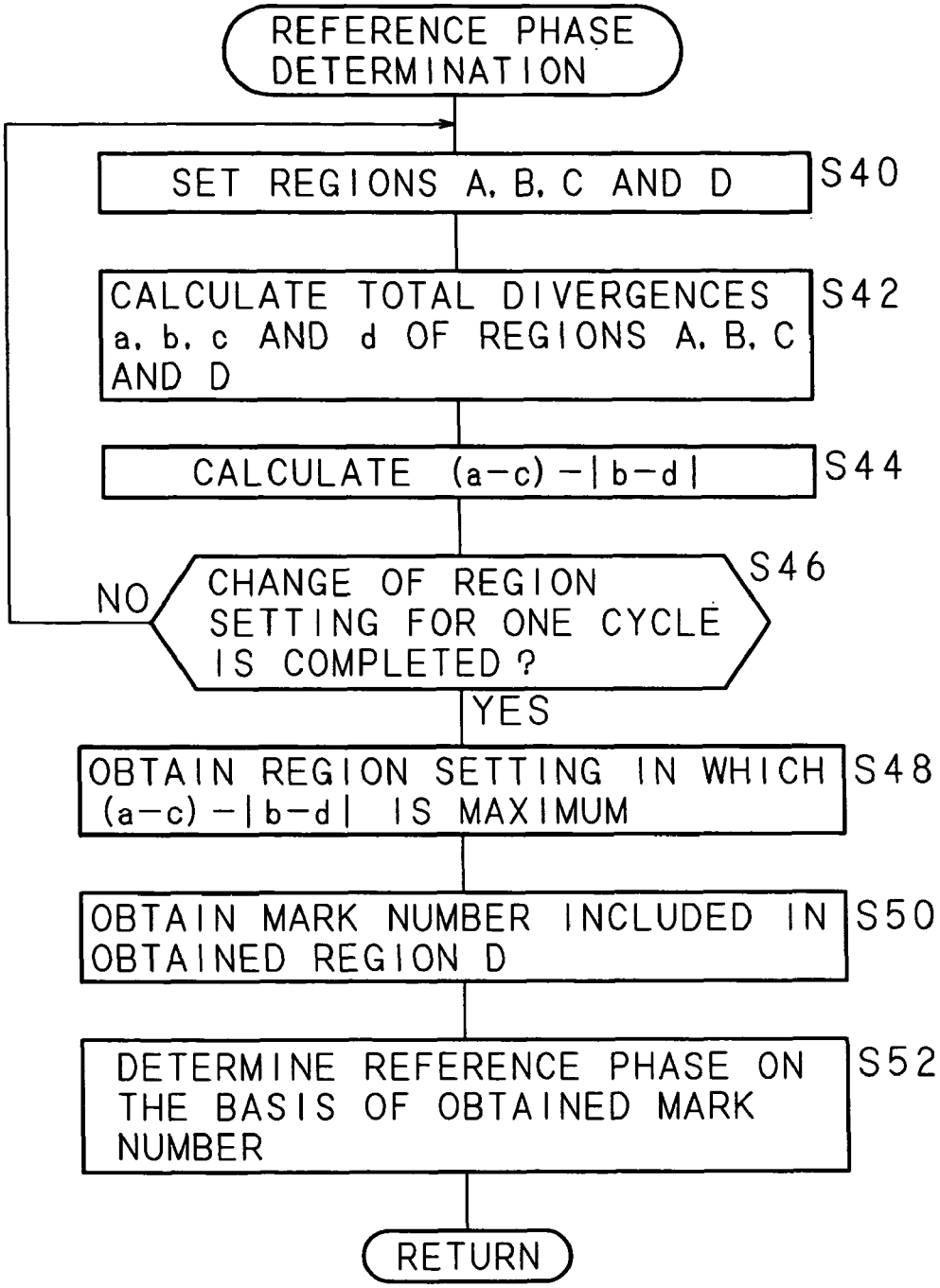
FIG. 11 is a flowchart showing an example of a reference phase determination procedure.

FIG. 11 is a flowchart showing an example of a reference phase determination procedure. The control section 60 sets the regions A, B, C and D (at step S40). For example, as an initial setting, region setting No. 1 is carried out, in which mark Nos. 1 to 4 are set in the region A, and mark Nos. 5 to 8, mark Nos. 9 to 12 and mark Nos. 13 to 16 are set in the regions B, C and D, respectively.

The control section 60 calculates the total divergences a, b, c and d of the regions A, B, C and D, respectively (at step S42), and stores the total divergences in the RAM 68. For example, in the case of region setting No. 1, the total of the divergences at the mark Nos. 1 to 4 is calculated as the total divergence a, and the totals of the divergences at the mark Nos. 5 to 8, mark Nos. 9 to 12 and mark Nos. 13 to 16 are calculated as the total divergences b, c and d, respectively. Next, the control section 60 calculates (a−c)−|b−d| (at step S44), and stores the result of the calculation in the RAM 68.

The calculation of (a−c)−|b−d| is carried out for each of the region setting Nos. 1 to 16. Hence, in the case that the change of region setting for one cycle is not completed (No at step S46), the control section 60 increases the region setting number by one, and calculates the total divergences a, b, c and d, and (a−c)−|b−d| in a way similar to that described above. In the case that the change of region setting for one cycle is completed (YES at step S46), the control section 60 obtains a region setting in which (a−c)−|b−d| is maximum, from among the region setting Nos. 1 to 16 (at step S48). Next, the control section 60 obtains a mark number included in the obtained region setting, the region D, for example (at step S50), determines the reference phase on the basis of the obtained mark number (at step S52), and stores the reference phase in the RAM 68.

By the detection of a region including a positive peak and a region including a negative peak without detecting the positive and negative peak values of divergences, influences owing to the formation errors or detection errors at the respective marks can be reduced, and the maximum portion of the divergences can be detected accurately. Furthermore, the reference phase based on the maximum portion can be determined accurately, and the reference phase can be aligned stably and accurately.

Regarding the total divergences a, b, c and d, the total divergences a, b, c and d of region setting No. 1 are herein obtained as follows:

Total divergence a=total of divergences at mark Nos. 1 to 4

Total divergence b=total of divergences at mark Nos. 5 to 8

Total divergence c=total of divergences at mark Nos. 9 to 12

Total divergence d=total of divergences at mark Nos. 13 to 16

On the other hand, the total divergences a, b, c and d of region setting No. 5 are obtained as follows:

Total divergence a=total of divergences at mark Nos. 5 to 8

Total divergence b=total of divergences at mark Nos. 9 to 12

Total divergence c=total of divergences at mark Nos. 13 to 16

Total divergence d=total of divergences at mark Nos. 1 to 4

All the total divergences have already been calculated in region setting No. 1. Hence, it is possible that the total divergences for the first four region settings among the 16 region settings are calculated, and that the total divergences calculated for the first four region settings are used for the remaining 12 region settings, without calculating the total divergences for the remaining 12 region settings. Furthermore, the divergence amounts are not limited to the total divergences, but the average values of divergences can also be used.

Although the four regions are set in the embodiment described above, it is possible to set eight or 16 regions, for example, multiples of four. In the case that eight regions (region 1 to region 8) are set, it is possible to carry out processing while the regions 1, 3, 5 and 7 are corresponded to the regions A, B, C and D described above, respectively. In this case, when the number of marks is 16, two marks are included in each region, and data is thinned. This raises the speed of calculation but lowers the detection accuracy of the maximum portions.

Furthermore, it is possible that one cycle is not divided into equal regions but divided into unequal regions; for example, mark Nos. 1 to 5 are assigned in the region A, mark Nos. 6 to 8 are assigned in the region B, mark Nos. 9 to 13 are assigned in the region C, and mark Nos. 14 to 16 are assigned in the region D. However, in the case of dividing one cycle into unequal regions, for example, the one cycle is divided into the regions A and B and the regions C and D so that the marks are distributed equally, so that the number of marks in the region A is the same as the number of marks in the region C, and so that the number of marks in the region B is the same as the number of marks in the region D. In other words, the one cycle is divided so that the marks are distributed equally, and so that the ratio and the arrangement order of the regions in one half cycle are the same as those of the regions in the other half cycle. Moreover, although the region setting is shifted by one mark unit so that each of mark Nos. 1, 2, 3, . . . , 13, 14, 15 and 16 is located at the head of each region in the embodiment described above, the region setting can be shifted by the desired number of mark units, for example, each of mark Nos. 1, 3, . . . , 13 and 15 is located at the head of each region.

Although the region setting in which $(a-c)-|b-d|$ is maximum is obtained in the embodiment described above, it is also possible to obtain the region setting in which $(a-c)$ is maximum. Furthermore, in the case of obtaining the region setting in which $(a-c)$ is maximum, even-numbered regions, such as 6 or 10 regions, can also be set, instead of setting four regions. In the case of setting six regions (regions 1 to 6), the regions 1 and 4 being away from each other by a half cycle can be processed so that they correspond to the regions A and C described above, respectively.

Still further, although the reference phase is determined accurately by calculating the divergence amounts in the present invention in the case that noise having a magnitude several times the divergence amount obtained usually is caused on rare occasions, the noise may affect the determination of the reference phase. For this reason, it may be possible that an upper limit is set for the divergence and that, in the case that a divergence equal to or more than the upper limit is detected the divergence is assumed to be the upper limit value. For example, in the case that the upper limit value of the divergence is set to two dots, when a divergence of two or more dots is detected, the divergence is assumed to be the upper limit value, two dots. In this way, the influence of the noise described above can be prevented, and the reference phase can be determined accurately.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus equipped with multiple image carriers on which images with different color components are formed respectively, and a driving section for rotating said image carriers, wherein multiple adjustment images are formed at a predetermined interval in an image forming region corresponding to the cycle length of one rotation of each image carrier, reference phases for the rotation of the respective image carriers are determined on the basis of maximum portions of divergences between the predetermined interval and a detected interval of each adjustment image, and said driving section is controlled so that the respective reference phases determined are aligned, comprising:

a calculating section for dividing the image forming region into a plurality of even-numbered divided regions, the divided regions being a multiple of four, and calculating the divergence amount of each divided region; and a determining section for determining the maximum portions on the basis of the divided regions in which the difference, between the divergence amounts of a first plurality of the divided regions being away from each other by a half cycle length and the absolute value of the difference between the divergence amounts of a second plurality of the divided regions being away from the first plurality of the divided regions by a quarter cycle length and being away from each other by a half cycle, is maximum.

2. The image forming apparatus according to claim 1, wherein said calculating section changes setting positions of the divided regions in the image forming region, and calculates the divergence amounts of the respective divided regions having different setting positions.

3. An image forming adjustment method wherein multiple image carriers on which images with different color components are formed respectively are rotated using a driving section, multiple adjustment images are formed at a predetermined interval in an image forming region corresponding to the cycle length of one rotation of each image carrier, reference phases for the rotation of the respective image carriers are determined on the basis of maximum portions of divergences between the predetermined interval and a detected interval of each adjustment image, and the driving section is controlled so that the respective reference phases determined are aligned, comprising the steps of:

dividing the image forming region into a plurality of even-numbered divided regions, the divided regions being a multiple of four, and calculating the divergence amount of each divided region; and determining the maximum portions on the basis of the divided regions in which the difference, between the divergence amounts of a first plurality of the divided regions being away from each other by a half cycle length and the absolute value of the difference between the divergence amounts of a second plurality of the divided regions being away from the first plurality of the divided regions by a quarter cycle length and being away from each other by a half cycle, is maximum.

4. The image forming adjustment method according to claim 3, wherein setting positions of the divided regions in the image forming region are changed, and the divergence amounts of the respective divided regions having different setting positions are calculated.

5. An image forming apparatus, comprising:

multiple image carriers on which images with different color components are formed respectively;

a driving section for rotating the image carriers;

an image forming region in which multiple adjustment images are formed at a predetermined interval corresponding to a cycle length of one rotation of each image carrier, reference phases for the rotation of the respective image carriers being determined on the basis of maximum portions of divergences between the predetermined interval and a detected interval of each adjustment image, the driving section being controlled so that the respective reference phases determined are aligned;

a calculating section for dividing the image forming region into a plurality of even-numbered divided regions, the divided regions being a multiple of four, and calculating the divergence amount of each divided region; and a determining section for determining the maximum portions on the basis of the divided regions in which the difference, between the divergence amounts of a first plurality of the divided regions being away from each other by a half cycle length and the absolute value of the difference between the divergence amounts of a second plurality of the divided regions being away from the first plurality of the divided regions by a quarter cycle length and being away from each other by a half cycle, is maximum.

* * * * *